US005092750A

United States Patent [19]

Leroy et al.

[11] Patent Number: 5,092,750

[45] Date of Patent: Mar. 3, 1992

[54] DEVICE FOR THE COMPRESSION AND STORAGE OF AIR

[75] Inventors: Frédéric Leroy, Saint-Cloud; André Charon, Louvres; Gérard Braque, Mitry-le-Neuf; Daniel Bauer, Le Raincy, all of France

[73] Assignee: L'Oreal, Paris, France

[21] Appl. No.: 614,112

[22] Filed: Nov. 16, 1990

[30] Foreign Application Priority Data

Dec. 18, 1989 [FR] France ..... 89 16718

[51] Int. Cl.[5] ..... F04B 21/02

[52] U.S. Cl. ..... 417/571; 417/313; 141/20

[58] Field of Search ..... 141/258, 3, 20, 113; 417/313, 571; 92/13

[56] References Cited

U.S. PATENT DOCUMENTS

| | | | |
|---|---|---|---|
| 2,514,223 | 6/1946 | Covins | 92/80 |
| 2,548,807 | 6/1947 | Morgan | 417/137 |
| 2,940,643 | 6/1960 | Olson | 417/572 |
| 3,237,659 | 5/1962 | Albrecht | 141/20 |
| 3,390,831 | 12/1966 | Eaton, Jr. | 417/534 |
| 4,202,470 | 5/1980 | Fujii | 141/20 |
| 4,699,044 | 10/1987 | Riggs | 92/13 |
| 4,730,999 | 8/1986 | Tsukuda et al. | 417/44 |
| 4,776,771 | 10/1988 | Kern | 417/307 |
| 4,941,809 | 7/1990 | Pinkerton | 92/13 |

FOREIGN PATENT DOCUMENTS

| | | |
|---|---|---|
| 8808407 | 6/1988 | Fed. Rep. of Germany . |
| 510136 | 2/1920 | France . |
| 691195 | 3/1930 | France . |
| 2285529 | 9/1975 | France . |
| 2062122 | 9/1980 | United Kingdom . |
| 2087485 | 10/1981 | United Kingdom . |

*Primary Examiner*—Richard A. Bertsch
*Assistant Examiner*—Charles G. Freay
*Attorney, Agent, or Firm*—Cushman, Darby & Cushman

[57] ABSTRACT

Device for the compression and storage of air comprising, on the one hand, a reservoir (1) provided with an air discharge head (5) intended for cooperation with a container to be charged with compressed air and, on the other hand, at least one compression chamber (C1), associated with air inlet valves (19) and air ejection valves (15) and with a compression element actuated by a motor means (13) compressing the volume of the chamber (C1) between a maximum volume and a minimum volume, the ratio between the maximum volume and the minimum volume of the said chamber (C1) being from 1.2 to 20.

12 Claims, 3 Drawing Sheets

DEVICE FOR THE COMPRESSION AND STORAGE OF AIR

The present invention concerns a device for the compression and storage of air. This device can be used for recharging compressed air reservoirs for actuating pneumatic jacks, associated with for example small robots, and for recharging aerosol cans with compressed air.

It is well known to recharge a reservoir with compressed air by means of a compressor and that a pressure contact is used for switching the compressor off when the air pressure has reached a specified value. Unfortunately, this system is not reliable because of the wear of the pressure contact. Moreover, these devices have a hysteresis of the order of 1 to 2 bars which is very inconvenient, because the supply of air to the reservoir is only restarted when the pressure therein has declined by this value. This is why the reservoir is also provided with a safety valve. Now, experience has shown that these valves frequently do not work any longer after a certain time; in these conditions, reliability is no longer ensured.

A first object of the invention is to provide a device for the compression and storage of air, comprising neither a pressure contact nor a safety valve, wherein the pressure inside the container is automatically limited to a specified value.

The device of the present invention is particularly advantageous for recharging aerosol cans with compressed air. In the following discussion, the term "aerosol can" will denote a pressurized container provided with at least one dispensing valve and intended to deliver a flow of the liquid stored in the container, the flow being generally in a divided form so as to constitute an aerosol.

In the field of research into substitutes for chlorinated fluorocarbons used as propellants for aerosol cans, it was found that compressed air provided a very advantageous solution because it is simple, inexpensive, and above all, because it has no ecological drawbacks. Yet the range of aerosol cans charged with compressed air is, of course, clearly smaller than the atomizing ranges provided by the chlorinated fluorocarbons, since the air cannot be liquefied in the pressure range used and since, in contrast to the phenomena occurring with the chlorinated fluorocarbons, the pressure of the gaseous propellant is thus not maintained by the vaporization of the liquefied phase of the propellant in the course of the dispensing; it follows therefrom that the pressure at the end of the dispensing becomes too low to allow a satisfactory spray jet to be obtained. To maintain the dispensing pressure above the minimum required for good spraying, it is not possible to increase the initial air pressure because of the mechanical strength of the cans and the risks of explosion. Hence, if it is desired to dispense all the product stored in the can with a good quality spray jet, it is necessary to make provision for recharging the can with compressed air in the course of the dispensing of the product.

Many devices for the compression and storage of compressed air have already been proposed for this purpose; in particular, stations for the compression and storage of air have been proposed by the Utility Model DE-GM 88-08407 for recharging aerosol cans with compressed air, comprising, in the same way as the device of the present invention, a reservoir intended to receive the compressed air, as well as at least one compression chamber associated with inlet and ejection valves and with a compression element actuated by motor means for delivering compressed air from the compression chamber to the reservoir (see also the DE-OS 3 716 377, DE-OS 1 500 568, DE-OS 3 702 309, DE-OS 3 711 874).

However, no concrete embodiment has, so far, been marketed. For the practical creation of such a compression station, there arose several problems, in particular as regards the pressure regulation in the reservoir, this being the pressure at which the aerosol cans will be subsequently charged. It has, indeed, been proposed to regulate the pressure of the container by means of a servo-mechanism, in particular an electronic one, making the operation of the compression element dependent on the pressure in the reservoir, registered for example, by a pressure sensor. Now such an electronic servo-mechanism is too expensive for a reasonable commercial exploitation of the stations provided therewith for the compression and storage of compressed air.

A second object of the invention is to propose a station of the above mentioned type, wherein the regulation of the pressure in the reservoir is obtained by a means different from that of an electronic servo-mechanism.

The Applicants have noted that an adequate regulation of the ratio of the dead volume of the compression chamber in relation to its total volume has made it possible to pressurize the reservoir of the station with a substantially asymptotic increase in pressure until the maximum desired pressure is reached. Since the compression chamber is kept at a substantially constant temperature, the pressure in the container is established on a permanent basis at an asymptotic value equal, in accordance with Mariotte's law, to the atmospheric pressure multiplied by the ratio between the total value of the compression chamber and its dead volume Hence, provided the ratio between the total volume and the dead volume of the compression chamber is suitably chosen, the compression is self-regulating and there is no need to use an electronic servo-mechanism. A secondary consequence of this property is to allow the compression pump and its motor to operate on a continuous basis, which considerably reduces the risk of wear in the motor due to changes in the operating conditions and to frequent switching.

Moreover, it has been found by the Applicant that the substantially isothermal compressions necessary for obtaining the stations set out above, could be easily obtained, provided the operating frequencies of the compression elements associated with the compression chambers were sufficiently low. Thus another object of the invention is the completely surprising and novel proposal for using microcompressors with slow cycles to fill the reservoir over long periods. It should be noted that this staggering of the period for filling the reservoir allows the use of a motor with a lower power rating, and hence a less expensive motor. Moreover, the slowness of the compression cycle reduces the thermal losses which would occur with a high increase in temperature occasioned by fast cycles, with the result that the device has a higher energy efficiency.

It has, moreover, become apparent independently of the above considerations that the utilization of such low operating frequencies permitted a considerable reduction in the noise emissions from the apparatus. Indeed, the choice of an appropriate motor and a sufficiently low operating frequency henceforth permits the creation of a completely silent air compression and storage station; this is another important advantage of the device proposed in accordance with the invention, it being possible for this device to be integrated without any particular nuisance effect, to rooms in dwellings or professional premises such as, for example, bathrooms, kitchens or hair salons.

Thus the object of the present invention is a device for the compression and storage of air comprising on the one hand, a reservoir for the compression and storage of air, this reservoir being provided with an air evacuation head and, on the other hand, at least one compression chamber associated with air inlet and ejection valves and with a compression element actuated by motor means, said compression element compressing the volume of the compression chamber between a maximum volume and a minimum volume (or dead volume) so as to deliver the compressed air through the ejection valve or valves of the compression chamber to the reservoir, characterized in that the ratio between the maximum volume and the minimum volume of the compression chamber up the line from the ejection valve or valves is from 1.2 to 20.

In a particular embodiment, the compression element is a piston linearly displaceable in a substantially leakproof manner in a pump body, the compression chamber associated with the piston then being delimited by the walls of the pump body and the piston.

Advantageously, the compression element is actuated at a frequency of from 0.1 Hertz to 10 Hertz.

Preferably, the linear displacement speed of the piston in the pump body wherewith it is associated, is from 0.1 to 50 cm/s, the ratio between the surface of the cross section of the piston (in $cm^2$) and its stroke (in cm) being from 0.1 cm and 3 cm. The stroke of the piston in the pump body wherewith it is associated can be adjustable.

Preferably, the compression chamber has a maximum volume of less than 100 $cm^3$ and more preferably it has a maximum volume from 1 to 10 $cm^3$. The motor means consumes a power of less than 25 watts and preferably, a power consumption of from 1 to 5 watts.

The reservoir may comprise internally a leakproof bag with flexible walls and with an extensible volume containing a liquefiable gas in equilibrium with its liquid phase. The volume of the reservoir is advantageously less than 15 liters. The total capacity of the station is preferably less than approximately 20 liters, it then being possible for the station to be integrated in elements of a room in a dwelling (for example a bathroom or kitchen), or of professional premises (such as a hair salon, infirmary, or a hospital ward) as, for example, medicine or storage cabinets, bathroom lighting fixtures, mirror cabinets, work tables, wash basins or sinks, hairdressing seats, hair drying hoods, beauty salon cubicles or hand driers.

Advantageously, the device comprises two compression chambers with one and the same compression element, the compression element delivering the air in a reciprocating motion from one of the compression chambers, while the other said chamber is being filled, and vice versa.

In a variant of the embodiment, the station comprises two pump bodies each associated with a piston, the pistons being actuated simultaneously and identically in a reciprocating motion by one and the same motor element, one of the pistons delivering the air from the corresponding compression chamber while the other ensures the filling of its associated compression chamber and vice versa. Thus provision can be made for the same pump body to comprise two compression chambers, separated from each other in a leakproof manner by a piston delivering the air from one of the compression chambers to the reservoir, while the other compression chamber is being filled, and vice versa. In the two cases, the motor means can be a geared motor actuating a piston in a reciprocating motion by means of a connecting rod-crank system. The pump body may in particular be disposed, at least partly, inside the reservoir.

In order that the invention may more readily be understood, several embodiments thereof, represented in the attached drawings, will be described below on a purely illustrative and non-restrictive basis.

In these drawings

Figure 1:
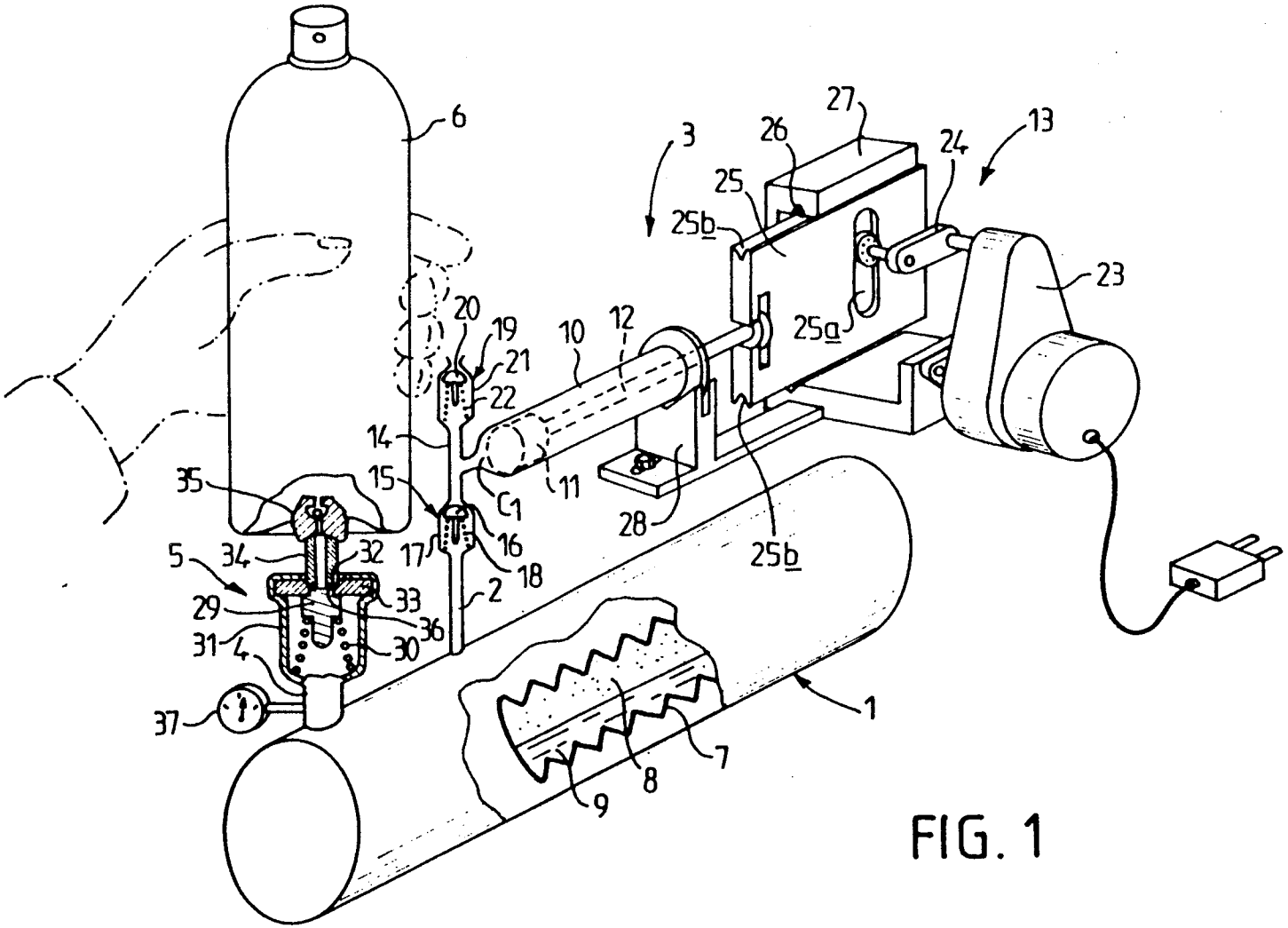
FIG. 1 is a schematic perspective, partly sectional, view of a compression and storage station in accordance with a first embodiment of the invention.

It will be seen in FIG. 1 that a compression and storage station in accordance with a first embodiment of the invention comprises a reservoir 1, wherein the air is intended to be compressed and stored. In this reservoir 1, there issues a first line 2 connected to compression means generally designated 3, as well as a second line 4 associated with a head 5 for the discharge of the air compressed in aerosol cans 6.

The reservoir 1 is a cylindrical 1.6 liter reservoir provided internally with a leakproof bag 7 with flexible sides; the bag 7 contains a chlorinated fluorocarbon gas 8 in equilibrium with its liquid phase 9. The compression means 3 comprise a compression chamber C1 which is delimited by the pump body 10 of a tubular cylindrical syringe and by a piston 11 displaced in a leakproof manner in the pump body 10; the outer diameter of this piston 11 corresponds substantially to the inner diameter of the pump body 10; the piston 11 is mounted on a rod 12 actuated by motor means 13.

The compression chamber C1 issues, on the side without the piston 11, in a line leading on one side to the line 2 connecting the compression chamber C1 to the reservoir 1, and, on the other side, to an air intake line 14. On the line 2, mounted between the compression chamber C1 and the reservoir 1, is a valve 15 which comprises a valve member 16 slidably mounted in a valve body 17; the valve member 16 is pushed back in the body 17 by a spring 18 exerting a force of a few grams, and bears on the seat of the valve body 17, the seat being situated at the end of the body 17 nearer the compression chamber C1. The line 14 issues towards the outside and comprises at its free end an air intake valve 19 similar to the valve 15, that is to say, comprising a valve member 20 sliding in a valve body 21 and being pushed back to the seat of the body 21 by a spring 22, the seat being disposed on the side of the body 21 which is farthest from the compression chamber C1.

The motor means 13 comprise in essence an electric geared motor 23 driving a crank 24, whose end is displaceable along an oblong cut out 25*a* arranged in a slide 25, to drive the slide in translation in a reciprocating motion. The slide 25 is joined to the rod 12 of the piston 11 displacing it along the axis of the rod 12. The slide is a rectangular plate whose lengthwise edges are parallel to the axis of the rod 12 and are provided with grooves 25*b* associated with balls 26 running in complementary recesses of a support 27, so as to guide the slide 25 in its translational movement. The motor 23 is fixedly mounted on the support 27 and causes the crank 24 to rotate at an angular speed of 10 r.p.m.; its maximum power is 3.5 watts.

The pump body 10 of the syringe is mounted, by its end remote from the compression chamber C1, on a base 28 whose distance from the support 27 is adjustable along the axial direction of the rod 12, so as to allow the stroke of the piston 11 to be adjusted in the pump body 10. As has already been explained above, such an adjustment permits an adjustment of the ratio between the minimum volume, (or dead volume), of the compression chamber 10 and its maximum volume and hence permits an adjustment of the asymptotic pressure for the filling of the reservoir 1. By way of example, with a maximum volume of the compression chamber of 2 $cm^3$ (with a diameter of 12 cm for the piston) and a dead volume of the order of 0.3 $cm^3$, one obtains an asymptotic pressure of the order of $3.5\times10^5$ Pascal.

The line 4 for the evacuation of the compressed gas to the aerosol cans 6 is itself associated with a head 5 constituting a valve and comprising a valve member 29 mounted on a spring 30 in a valve body 31; the valve member 29 cooperates with the seat 32 of the body 31 which issues towards the outside, the seat 32 surrounding an opening formed at the top 33 of the body 31 and flaring outwardly slightly. The valve member 29 is extended by a hollow tubular element 34 intended to cooperate with the non-return valve female element 35 of an aerosol can 6, for filling the can 6 with compressed gas. Ducts 36 for the compressed air are formed between the tubular element 34 and the valve member 29, so that when one bears on the tubular element 34, these ducts 36 disengage from the top 33 of the housing 31 and the compressed air passes through the ducts 36, then inside the tubular element 34 and finally, into the aerosol can 6. On the line 4, a manometer 37 is mounted between the valve body 31 and the reservoir 1 to make it possible to satisfy oneself that the compression means 3 are properly adjusted.

It should be noted that with such an apparatus, the reservoir can be recharged at its asymptotic pressure in approximately 4 hours, and as regards an aerosol can 6, this can be recharged in a few seconds. Once the reservoir 1 is recharged, it is then possible to accomplish approximately six successive recharging operations of an aerosol can of volume 305 $cm^3$ having approximately 30% of its internal volume filled with a liquid to be dispensed; this recharging is effected at a pressure exceeding 2 bars, each recharge allowing spraying over a period of 20 to 30 seconds. As the reservoir 1 is emptied of its compressed air, the bag 7 expands, and the chlorinated fluorocarbon liquid 9 partly passes into its gaseous phase, thus substantially compensating the internal pressure loss of the reservoir. It is thus possible to obtain, with such an air compression and storage station, approximately 9 aerosol can refills per day, three in the morning, three at midday and three in the evening.

Figure 2:
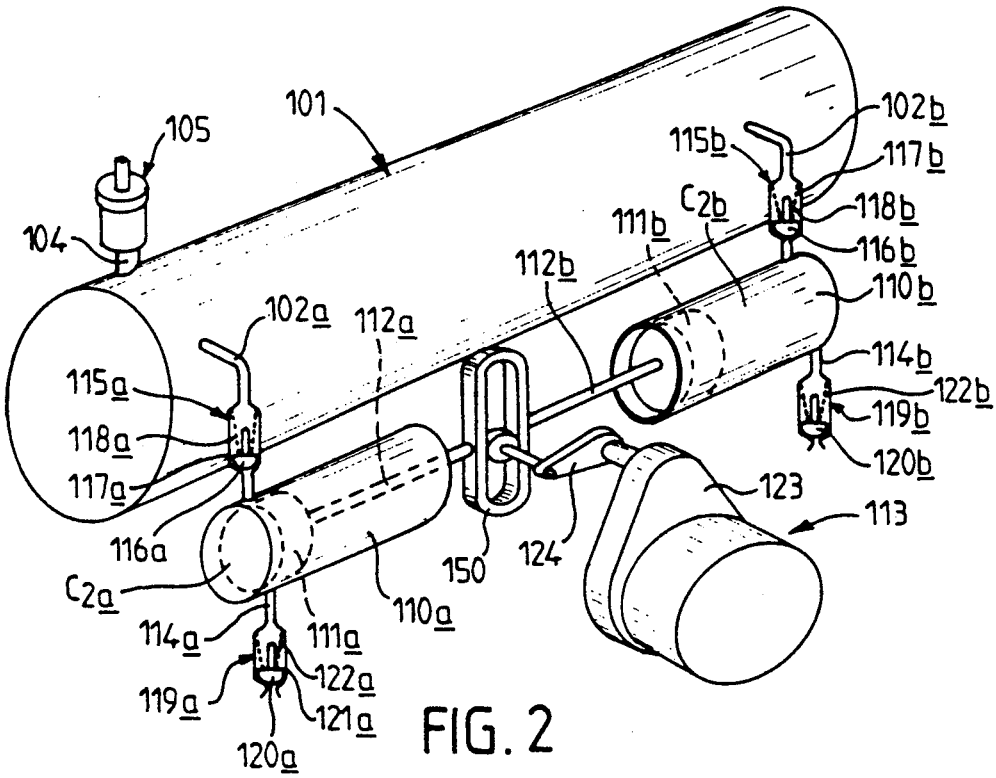
FIG. 2 is a view similar to FIG. 1 of a station in accordance with a second embodiment of the invention.

FIG. 2 shows a micro-station for the compression and storage of air in accordance with a second embodiment of the invention, for which the same reference numerals have been kept, increased by 100 with regard to corresponding elements that also appear in the above described first embodiment of micro-station for the compression and storage of air.

From FIG. 2, it will be seen that this second micro-compression station comprises a reservoir 101 connected on the one hand, to a head 105 for evacuating the compressed air into the aerosol cans and, on the other hand, to two lines 102*a* and 102*b* connecting the reservoir 101 to compression chambers bearing the reference numerals C2*a* and C2*b* respectively. Each of these two compression chambers is delimited by a pump body 110*a* and 110*b* respectively, and a respective piston 111*a* or 111*b* mounted on a rod 112*a* or 112*b* respectively.

These two rods 112*a* and 112*b* are coaxial in each other's extensions and are interconnected by a sliding key member 150 wherewith there cooperates a crank 124 actuated by a geared motor 123. In this way, a simultaneous air compression is obtained for each forward and return movement of the key member 150.

Figure 3:
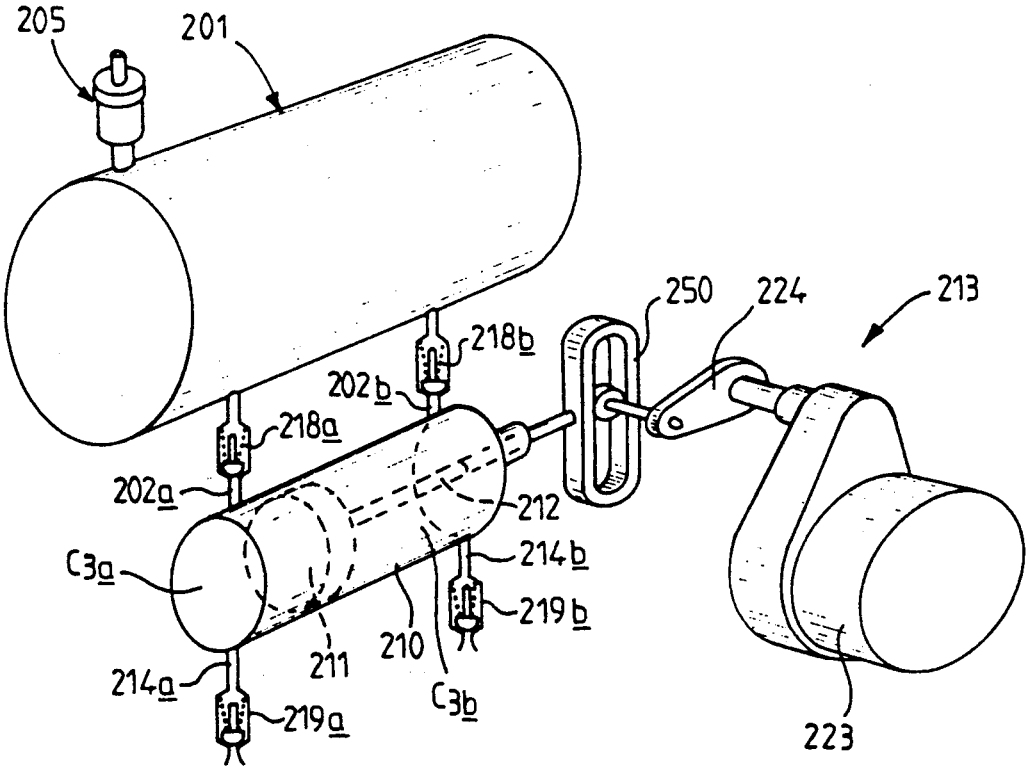
FIG. 3 is a view similar to FIG. 1 of a station in accordance with a third embodiment of the invention.

FIG. 3 shows a third embodiment of micro-compression station according to the invention, for which the same reference numerals have been retained but now increased by 200, with regard to the corresponding elements of FIG. 1.

As may be seen in this Figure, this micro-station comprises a reservoir 201 and a pump body 210 associated with a piston 211 slidably mounted in the body 210; the piston 211 is joined coaxially to a rod 212 actuated in translation in a leakproof manner in the pump body 210 by motor means 213 comprising a sliding key member 250 wherewith there cooperates a crank 224 driven by a geared motor 223.

The pump body 210 is provided at each one of its ends with lines 202*a* and 202*b* for delivering the air to the container 201, and with air intake lines 214*a* and 214*b*, and it is closed at each one of its ends, so that the piston 211 separates it into two compression chambers C3*a* and C3*b*, which it compresses alternately in its reciprocating motion without any empty stroke of piston 211. The charging of a aerosol can is effected by means of a head 205 similar to the head 5.

Figure 4:
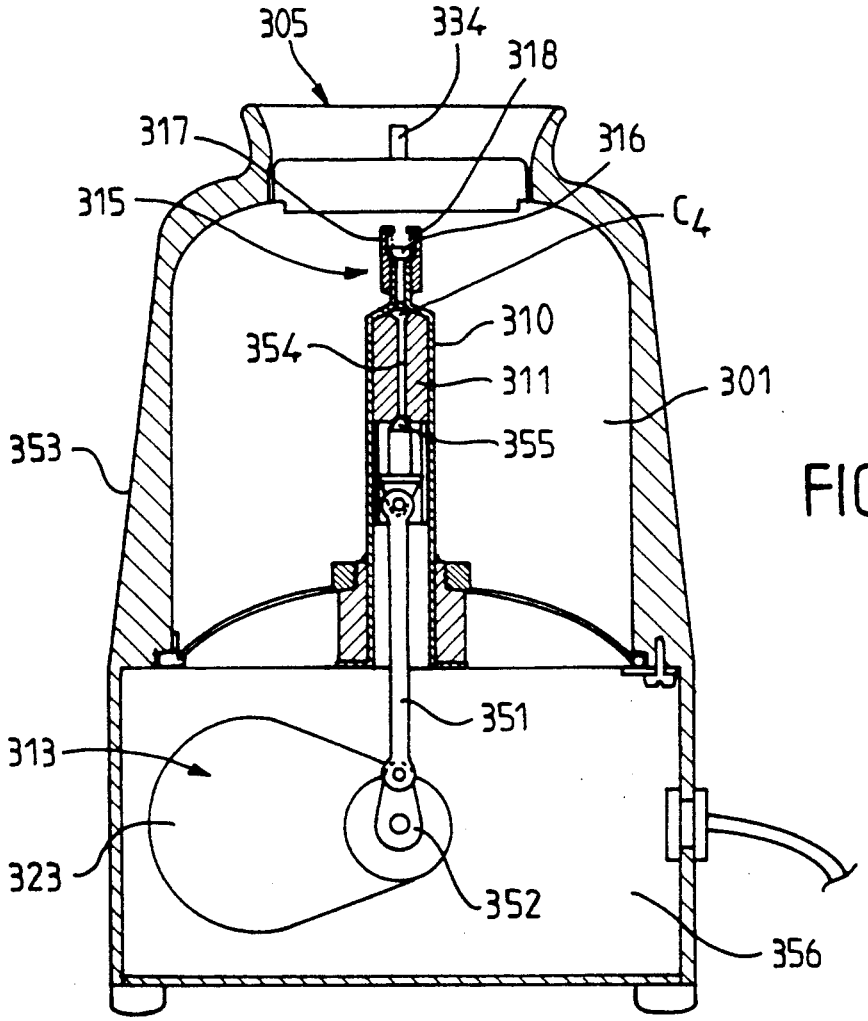
FIG. 4 is a schematic axial sectional view of a compression station in accordance with a fourth embodiment of the invention.

FIG. 4 shows a fourth embodiment of compression station according to the invention, for which the reference numerals have now been incremented by 300 over those in the first compression station. This concerns a more compact micro-compression station.

It will be seen in FIG. 4 that this micro-compression station comprises a reservoir 301 wherein there is mounted a pump body 310 issuing into the reservoir 301 via an ejection valve 315 of the type of those described above, the body 310 being associated with a piston 311. At its other end, the pump body 310 issues in a chamber 356 that is connected to atmosphere and wherein there are disposed the motor means 313 for the pump. The assembly is mounted in a rigid shell 353 at whose end an aerosol can may be fitted for being recharged. The piston 311, which in the Figure is represented at the end of the compression stroke, is traversed along its axis by a duct 354 issuing into the compression chamber C4 of the pump, the duct 354 being associated at its other end with a needle 355 serving, in relation to the opening of the duct 354, as a positive control valve closing the duct 354 when the piston 311 is pushed back towards the valve 315. The needle 355 is pivotably articulated on a link rod 351 itself articulated at its other end on a crank 352 driven by a geared motor 323. The needle 355 is, moreover, joined to the piston 311 with a clearance, such that when the needle 355 is translated in the pump body 310 towards the valve 315, it closes the duct 354, and when it is translated in the opposite direction in the body 310, it entrains the piston without obturating the duct 354. This makes it possible to obtain the ejection of air compressed by the piston 311 into the reservoir 301, or to refill the compression chamber C4 by air passing from the chamber 356 through the duct 354.

We claim:

1. A device for the compression and storage of air comprising a reservoir for the compression and storage of air, said reservoir being provided with an air discharge head and at least one compression chamber, said compression chamber having air inlet valve means and air ejection valve means and a compression element, motor means for moving said compression element in said compression chamber to compress the volume of said chamber between a maximum volume and a minimum volume to thereby deliver compressed air through said ejection valve means, said ejection valve means being connected to said reservoir, the ratio between the maximum volume and the minimum volume of said compression chamber upstream relative to said ejection valve means being from 1.2 to 20, said compression element operating at a frequency of from 0.1 Hertz to 10 Hertz.

2. A device according to claim 1, characterized in that the compression element (11, 111, 211, 311) is a piston linearly displaceable in a substantially leakproof manner in a pump body (10, 110, 210, 310), the compression chamber (C1; C2*a*, C2*b*; C3*a*, C3*b*; C4) associated with the compression element being delimited by the walls of a pump body (10, 110, 210, 310) and the piston (11, 111, 211, 311).

3. A device according to claim 1, characterized in that the displacement speed of the piston (11, 111, 211, 311) in the pump body (10, 110, 210, 310) wherewith it is associated, is from 0.1 cm/s to 50 cm/s.

4. A device according to claim 3, characterized in that the ratio between the surface of the cross section (in $cm^2$) of the piston and its stroke (in cm) is from 0.1 cm to 3 cm.

5. A device according to claim 1, characterized in that the compression chamber (C1; C2*a*, C2*b*; C3*a*, C3*b*; C4) has a maximum volume of less than 100 $cm^3$.

6. A device according to claim 1, characterized in that the motor means (13, 113, 213, 313) has a maximum power of less than 25 watts.

7. A device according to claim 1, characterized in that the volume of the reservoir (1, 101, 201, 301) is less than 15 liters and that the total capacity of the device is less than approximately 20 liters.

8. A device according to claim 1, characterized in that the motor means is a geared motor (23, 123, 223, 323) actuating a piston (11, 111, 211, 311) in a reciprocating motion via a link rod-crank system (24, 124, 224, 352).

9. A device according to claim 1, characterized in that the reservoir (1) comprises internally a leakproof bag (7) having flexible sides and an extensible volume, containing a liquefiable gas (8) in equilibrium with its liquid phase (9).

10. A device according to claim 1, characterized in that the stroke of the piston (11) in the pump body (10) wherewith it is associated, is adjustable.

11. A device according to claim 1, characterized in that said device comprises two compression chambers (C2*a*, C2*b*; C3*a*, C3*b*) associated with one and the same compression element, the said compression element (111*a*, 112*a*, 150, 111*b*, 112*b*; 211, 212, 250) delivering, in a reciprocating motion, the air from one (C2*a*, C3*a*) of the compression chambers, while the other (C2*b*, C3*b*) of said chambers is being filled, and vice versa.

12. A device according to claim 2, characterized in that the pump body (310) is disposed, at least partly, inside the reservoir (301).

* * * * *